US006851776B2

(12) United States Patent
Bienick

(10) Patent No.: US 6,851,776 B2
(45) Date of Patent: Feb. 8, 2005

(54) REFRIGERATOR COMPARTMENT HOUSING VERTICALLY ADJUSTABLE SHELVES, EACH FORMED FROM A PIECE OF TEMPERED GLASS TO WHICH IS INJECTION MOLDED A FRAME IN THE FORM OF FRONT AND REAR BORDER MEMBERS

(75) Inventor: Craig Bienick, Jenison, MI (US)

(73) Assignee: Gemtron Corporation, Sweetwater, TN (US)

( * ) Notice: Subject to any disclaimer, the term of this patent is extended or adjusted under 35 U.S.C. 154(b) by 138 days.

(21) Appl. No.: 09/892,503

(22) Filed: Jun. 28, 2001

(65) Prior Publication Data

US 2003/0006683 A1 Jan. 9, 2003

(51) Int. Cl.[7] ..... A47B 96/02
(52) U.S. Cl. ..... 312/408
(58) Field of Search ..... 312/407.1, 408, 312/401, 407, 410; 211/134, 135; 108/184; 40/780, 739, 741

(56) References Cited

U.S. PATENT DOCUMENTS

D142,904 S * 11/1945 Paddock ..... D15/89
3,425,147 A * 2/1969 Marx ..... 40/780
3,633,983 A * 1/1972 Whitcomb ..... 312/306
3,857,624 A * 12/1974 Peterson ..... 312/408
4,923,260 A * 5/1990 Poulsen ..... 312/408
5,273,354 A 12/1993 Herrmann et al.
5,362,145 A 11/1994 Bird et al.
5,403,084 A 4/1995 Kane et al.
5,406,894 A * 4/1995 Herrmann et al. ..... 108/108
5,429,433 A 7/1995 Bird et al.
5,441,338 A 8/1995 Kane et al.
5,454,638 A 10/1995 Bird et al.
5,540,493 A 7/1996 Kane et al.
5,735,589 A 4/1998 Herrmann et al.
6,422,673 B1 * 7/2002 Bienick ..... 312/408

FOREIGN PATENT DOCUMENTS

EP 856712 * 8/1998
FR 2 660 740 A1 * 10/1991
FR 2720145 * 11/1995

* cited by examiner

*Primary Examiner*—James O. Hansen
(74) *Attorney, Agent, or Firm*—Diller, Ramik & Wight

(57) ABSTRACT

A shelf for a refrigerator compartment includes a tempered glass panel to front and rear edges of which are injection molded or adhesively bonded front and rear border members. Side edges of the tempered glass panel are thereby exposed enhancing conductivity within the refrigerator compartment.

13 Claims, 5 Drawing Sheets

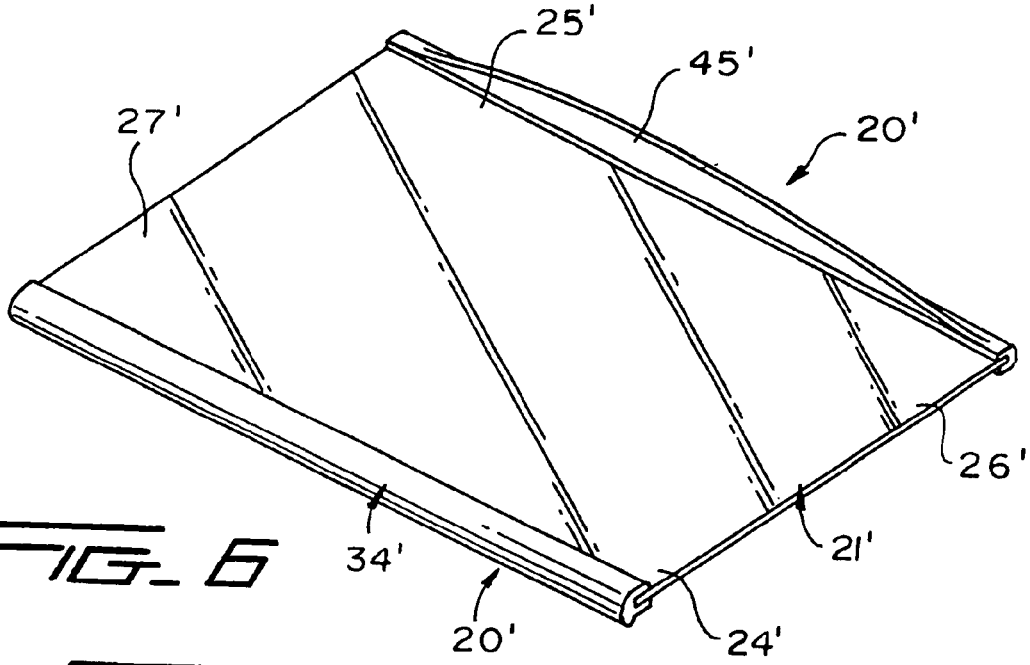
FIG. 6
FIG. 7
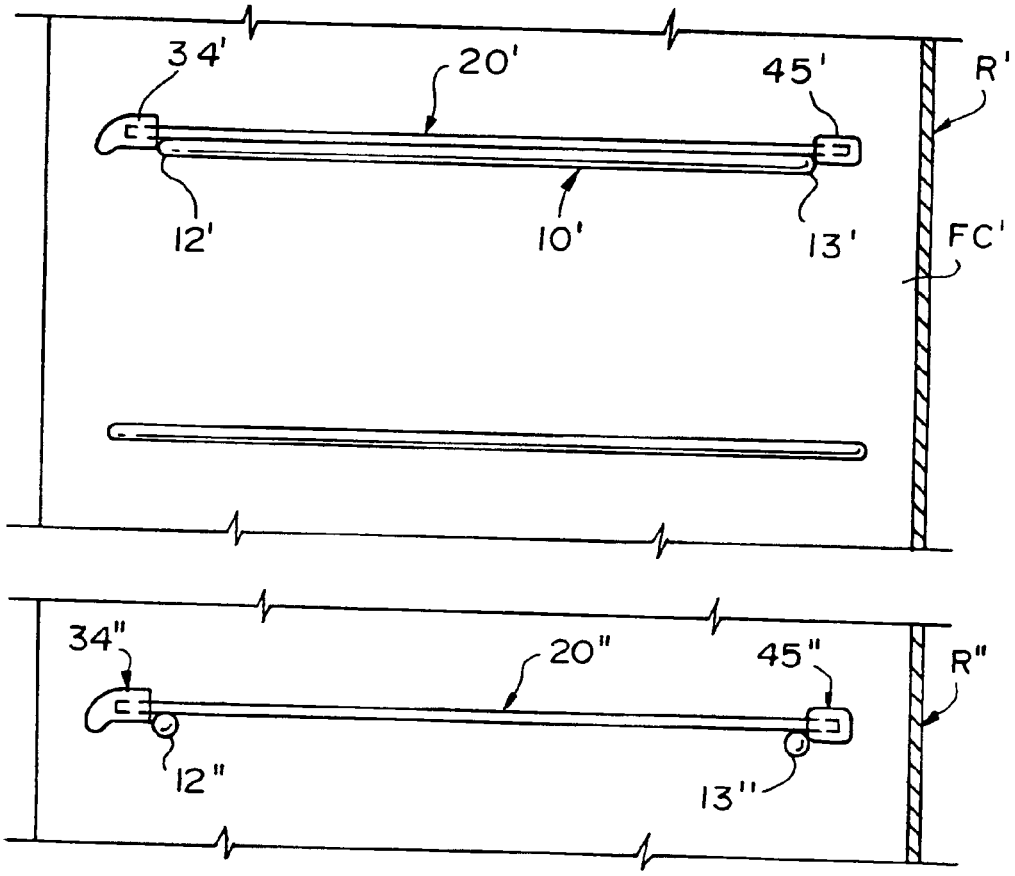
FIG. 8

REFRIGERATOR COMPARTMENT HOUSING VERTICALLY ADJUSTABLE SHELVES, EACH FORMED FROM A PIECE OF TEMPERED GLASS TO WHICH IS INJECTION MOLDED A FRAME IN THE FORM OF FRONT AND REAR BORDER MEMBERS

BACKGROUND OF THE INVENTION

Adjustable shelves are commonly associated with both the freezer compartment and the fresh food compartment of conventional side-by-side refrigerators. When the shelves are constructed as sliding shelves, opposite generally parallel side edges of the shelves rest upon and slide relative to horizontally aligned ribs or grooves formed as opposing pairs in the side walls of the freezer compartment, the fresh food compartment or both, or inner liners thereof. Typical of such shelves, which can be sliding, cantilevered and/or vertically step-adjusted, are disclosed in the following patents:

| U.S. Pat. No. : | Inventor: | Patented: |
|---|---|---|
| 5,273,354 | Hermann et al. | Dec. 28, 1993 |
| 5,362,145 | Bird et al. | Nov. 8, 1994 |
| 5,403,084 | Kane et al. | Apr. 4, 1995 |
| 5,429,433 | Bird et al. | Jul. 4, 1995 |
| 5,441,338 | Kane et al. | Aug. 15, 1995 |
| 5,454,638 | Bird et al. | Oct. 3, 1995 |
| 5,540,493 | Kane et al. | Jul. 30, 1996 |
| 5,735,589 | Herrmann et al. | Apr. 7, 1998 |

The latter listing of patents are not only exemplary of adjustable shelving of the type just described, but the shelves thereof each include at least as one component thereof a piece of tempered glass about the periphery of which is an injection molded encapsulation, border or frame which totally peripherally encapsulates the tempered glass peripheral edge. Perhaps the simplest example of the latter is the shelf of U.S. Pat. No. 5,362,145 in which a rim 12 is molded around an entire perimeter edge 22 of a glass shelf member 12 and two opposite metallic side brackets 14 and 16 which support the overall shelf 10 in a cantilevered fashion from a pair of vertical tracks 44 located against a rear wall 20 of an associated refrigerator. In the embodiment of the shelf 110 of FIG. 2, the shelf slides relative to side brackets 140, 142 and is thereby constructed only from a piece of tempered glass 112 and a peripheral injection molded encapsulation, border or frame 118. The shelf 110 can slide along the side brackets 114, 116.

A shelf similarly constructed from a single piece of tempered glass and having secured to a peripheral edge thereof a peripheral encapsulation, border or frame is disclosed in application Ser. No.09/834,896 entitled a "Refrigerator Compartment Housing Vertically Adjustable Shelves" filed on Apr. 16, 2001 in the name of Craig Bienick and now Pat. No. 6,422,673 B1. The latter encapsulation is snap-secured to the glass panel, but the significance of this disclosure is that each shelf can be step-wise adjusted within an associated refrigerator compartment and is limited in its forward and rearward sliding movement by appropriate stops and abutments. Side border portions of the shelf are narrowed to accommodate stops or abutments carried by rails or guides of the refrigerator compartment.

The latter disclosure comes perhaps closest to resembling the present invention, though the present invention is considered an unobvious improvement thereover. Obviously, snap-securing a separately injection molded frame to a glass panel requires an additional manufacturing step which is cost-additive to the overall final cost of each shelf. Moreover, if an adhesive is used to secure the peripheral edges of the glass panel to the snap-secured frame, additional costs are encountered which include not only the cost of the adhesive but cleaning up adhesive if an overabundance of adhesive is utilized during the glass-to-encapsulation bonding process. Obviously, additional adhesive and adhesive clean-up problems increase the overall costs of such a shelf. Additionally, since side portions of the encapsulation are reduced in thickness, the same are weakened relative to the remaining thicker portions of the encapsulation rendering the encapsulation susceptible to breakage in these narrower side border portions. Thus, though the reduced thickness of the side border portions increases air flow in the refrigerator compartment, it also subjects the shelf to fracture in these areas of reduced thickness.

BRIEF SUMMARY OF THE INVENTION

In keeping with the foregoing, a novel shelf is provided in accordance with this invention for utilization in a refrigerator compartment which includes side walls having a plurality of vertically spaced shelf-supporting ledges in the form of ribs or channels. Each shelf can be stepped-adjusted vertically between pairs of ribs and each shelf can be slid along the ribs between innermost and outermost positions. However, as opposed to the shelf last described, the shelf of the present invention is defined by a piece of glass and front and rear border members each made of polymeric/copolymeric synthetic plastic material. The glass piece has opposite side edges and opposite front and rear edges and the front and rear border members are injection molded or adhesively bonded to the front and rear edges of the glass piece. Due to the latter construction, at least a portion of each glass piece side edge disposed between the front and rear border members is substantially completely exposed. By essentially eliminating side portions of a conventional four-sided encapsulation or frame and exposing side edges of the glass panel, the conductivity of the shelf is proportionally increased by the area of the edge of the glass panel totally exposed to the interior of an associated refrigerator compartment. Moreover, the shelf seats upon, rests and/or slides upon relatively short side border edges of the front and rear border members which effectively raise the shelf and particularly the glass panel thereof above the ribs of the refrigerator compartment. This creates an air gap between the ribs and the exposed side edges of the glass panel which also increases air flow through the refrigerator compartment thereby increasing the efficiency thereof.

Though the shelf of the present invention is preferably constructed from a piece of tempered glass having injection molded at front and rear edges thereof respective front and rear border members each having side edge border portions, in further accordance with the present invention, the side edge border portions can be completely eliminated thereby exposing substantially the entire side edges of the tempered glass panel.

In accordance with yet another embodiment of the invention, at least the rear border member can have its ends foreshortened to expose the rear corners of the glass panel. This construction would allow the shelf to slide entirely upon side edges of the glass panel and not upon side edge portions of the front and rear border members.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 6 is a top perspective view of another shelf constructed in accordance with this invention, and illustrates a piece of tempered glass or a tempered glass panel having bonded to front and rear edges thereof respective front and rear border members with side edges of the glass panel being substantially entirely exposed.

FIG. 7 is a vertical cross-sectional view through a refrigerator compartment similar to FIG. 2, and illustrates two ribs on one side wall thereof with the shelf immovably nonslidably supported upon the upper rib.

FIG. 8 is a vertical cross-sectional view through a refrigerator compart similar to FIG. 7, and illustrates the side wall having two outwardly projecting bosses supporting the shelf of FIG. 6 in nonsliding relationship thereupon.

DETAILED DESCRIPTION OF THE INVENTION

Figure 1:
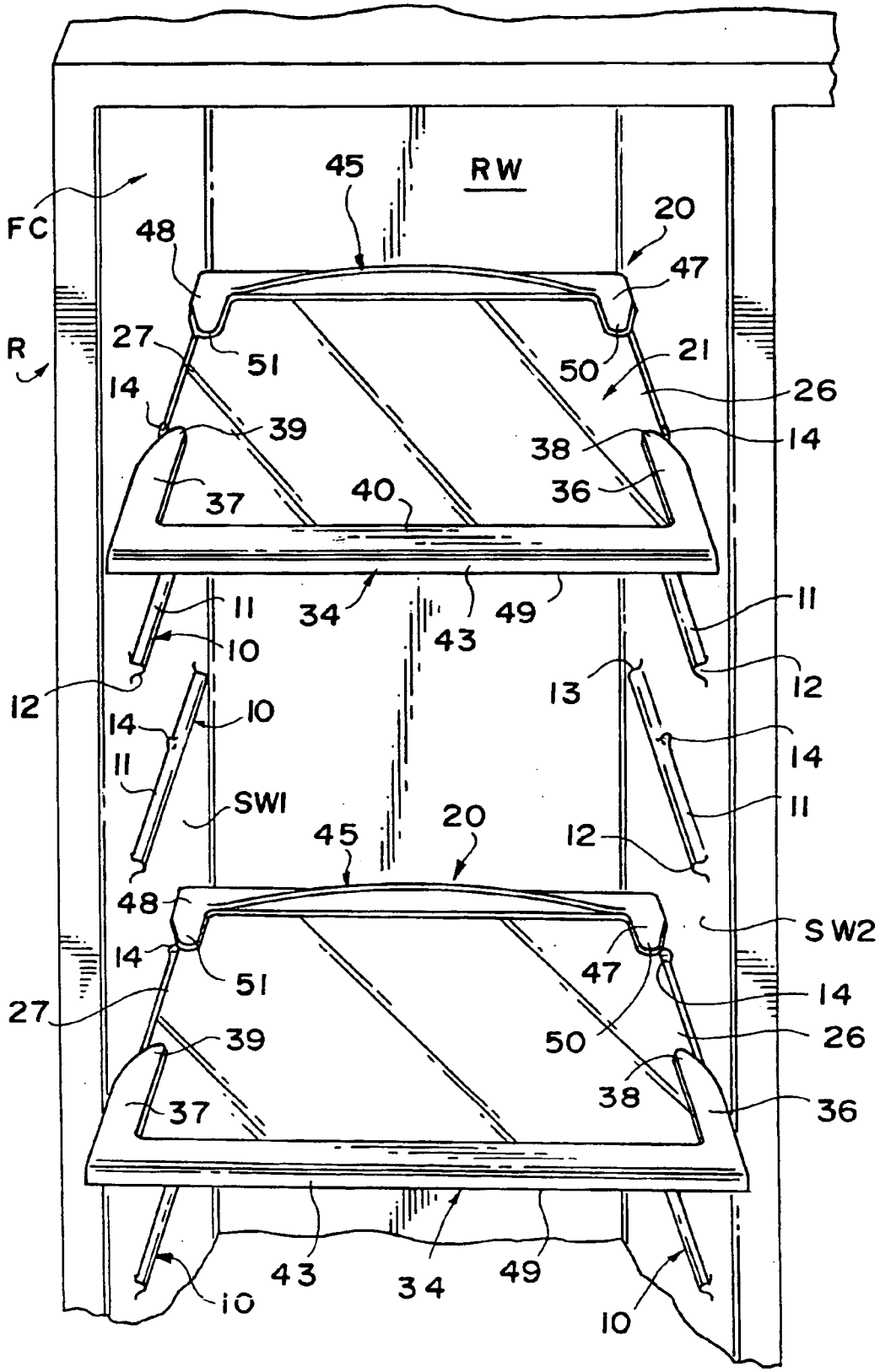
FIG. 1 is a fragmentary front perspective view of a refrigerator, and illustrates a fresh food compartment, a freezer compartment and two shelves in the freezer compartment in two different positions relative to underlying supporting ribs or ledges.

A refrigerator R (FIGS. 1 and 2) includes a fresh food compartment FFC and a freezer compartment FC. The freezer compartment FC includes a back or rear wall RW and opposite generally parallel side walls SW1 and SW2, each of which includes a plurality of vertically spaced ledges or ribs 10. Opposite ribs 10 project toward each other in associated pairs in a common horizontal plane, and each rib 10 includes an upper wall 11, an entrance end 12 and a rear end 13 which is spaced from the rear wall RW.

Abutment means or stop means 14 in the form of an upwardly projecting stop or abutment is located between the entrance end 12 and the rear end 13 of each of the ledges or ribs 10 (FIG. 2) and cooperates with each of a plurality of identical shelves 20, in a manner to be described more fully hereinafter, to limit the sliding movement of the shelves 20 between the two positions illustrated in FIGS. 1 and 2 of the drawings.

Figure 5:
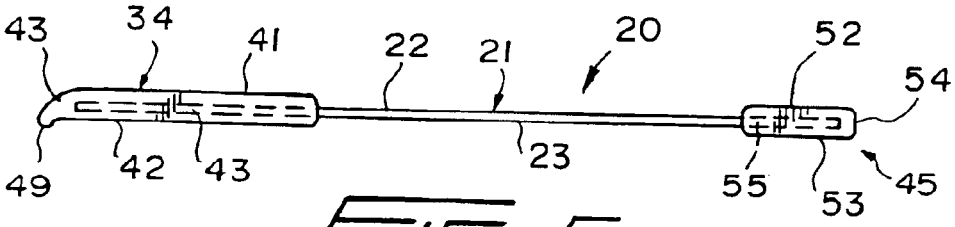
FIG. 5 is the side elevational view of the shelf looking from right-to-left in FIG. 3, and illustrates a side edge portion of the glass panel exposed between side border portions of the front and rear border members.

Each shelf 20 includes a polygonal, rectangular or square piece of tempered glass 21 having an upper surface 22 and a lower surface 23 (FIG. 5). The glass panel 21 includes a peripheral edge defined by a front edge 24 (FIG. 3) which is substantially parallel to a rear edge 25 and side edges 26, 27 which are substantially parallel to each other.

Each shelf 20 further includes a front border member 34 and a rear border member 45 which, as viewed in top or bottom plan (FIG. 3), is of a generally U-shaped configuration. The front and rear border members 34, 45, respectively, are bonded to the respective front and rear edges 24, 25 and to portions of the side edges 26, 27 of the glass panel 21 by being injection molded thereto in a manner apparent from, for example, U.S. Pat. No. 5,540,493. If required or found necessary, the front and rear edges 24, 25 of the glass panel 21 and portions of the side edges 26, 27 can be primed before the injection molding process to additionally assure a tight adhesive bond between the border members 34, 45 and the respective edges 24, 25, though in practice, such priming has been found unnecessary. The border members 34, 45 can also be separately injection molded with a channel or slot to accommodate the post molded adhesive bonding of the glass edges 24, 25 to the border members 34, 45.

The front border member 34 includes a bight border portion 35 and opposite substantially parallel side border portions 36, 37 each terminating at respective ends or noses 38, 39. The front border 34 also includes an upper inwardly directed flange 40, a corresponding lower flange 42 and a bight wall portion 43 therebetween collectively defining a generally inwardly opening U-shaped channel 44 within which is received and to which is bonded the rear edge 24 and portions of the side edges 26, 27 of the glass panel 21 during the injection molding operation or post molded adhesive bonding as heretofore described. The bight wall portion 43 at a forwardmost edge 49 may be curved in a downward direction (FIG. 5) to define a handgrip portion or handle to facilitate a user grasping the front border 43 to manipulate the shelf 20 as might be required during installation, use and/or removal from an associated refrigerator compartment.

The rear border 45 is injection molded or post bonded to the rear edge 25 and to portions of the side edges 26, 27 of the glass panel 21 and is of a configuration corresponding substantially identically to that of the front border member 34 including the generally U-shaped configuration thereof. The rear border member 45 includes a bight border portion 46 and opposite substantially parallel side border portions 47, 48, each terminating in respective ends or noses 50, 51. The rear border member 45 further includes an upper inwardly directed flange 52, a similar lower flange 53 and a bight wall portion 54 therebetween (FIG. 5) collectively defining a generally U-shaped channel 55 within which is housed the rear edge 25 and portions of the side edges 26, 27 of the glass panel 21.

Figure 3:
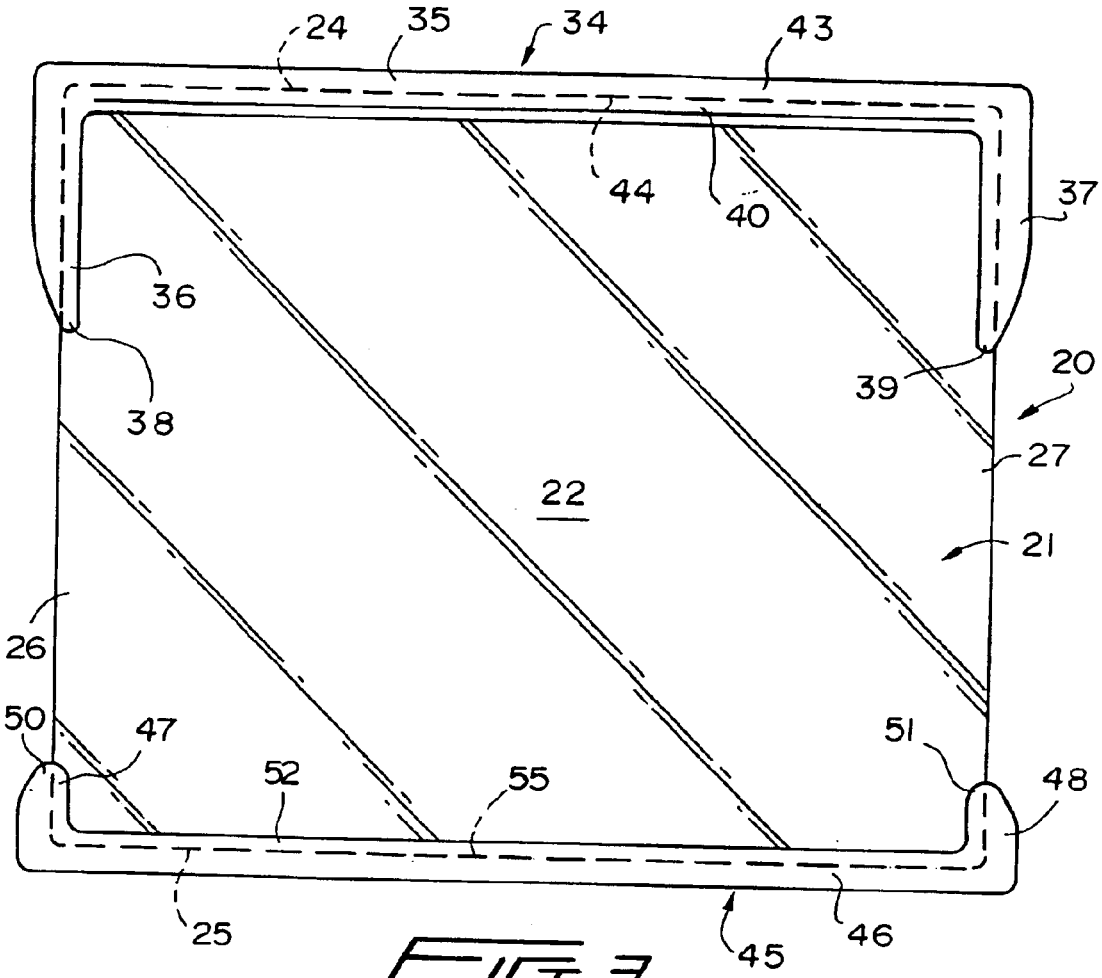
FIG. 3 is a top plan view of the shelf of the present invention, and illustrates a single piece of tempered glass having injection molded to front and rear edges of the glass respective front and rear border members, each having relatively short side edge portions which expose major side edges of the piece of glass or glass panel.
Figure 4:
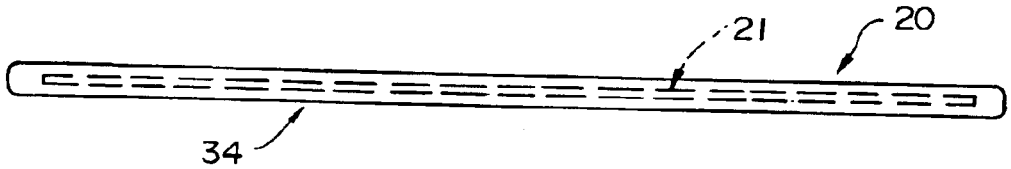
FIG. 4 is a front elevational view of the shelf of FIG. 3, and illustrates the manner in which the front edge of the glass panel is completely encapsulated by the front border member.

As is most readily apparent from FIG. 3 of the drawings, a major edge portion of the side edge 26 of the glass panel 21 between the noses 38, 50 is exposed, as is a major portion of the side edge 27 of the glass panel 21 between the noses 39, 51.

Figure 2:
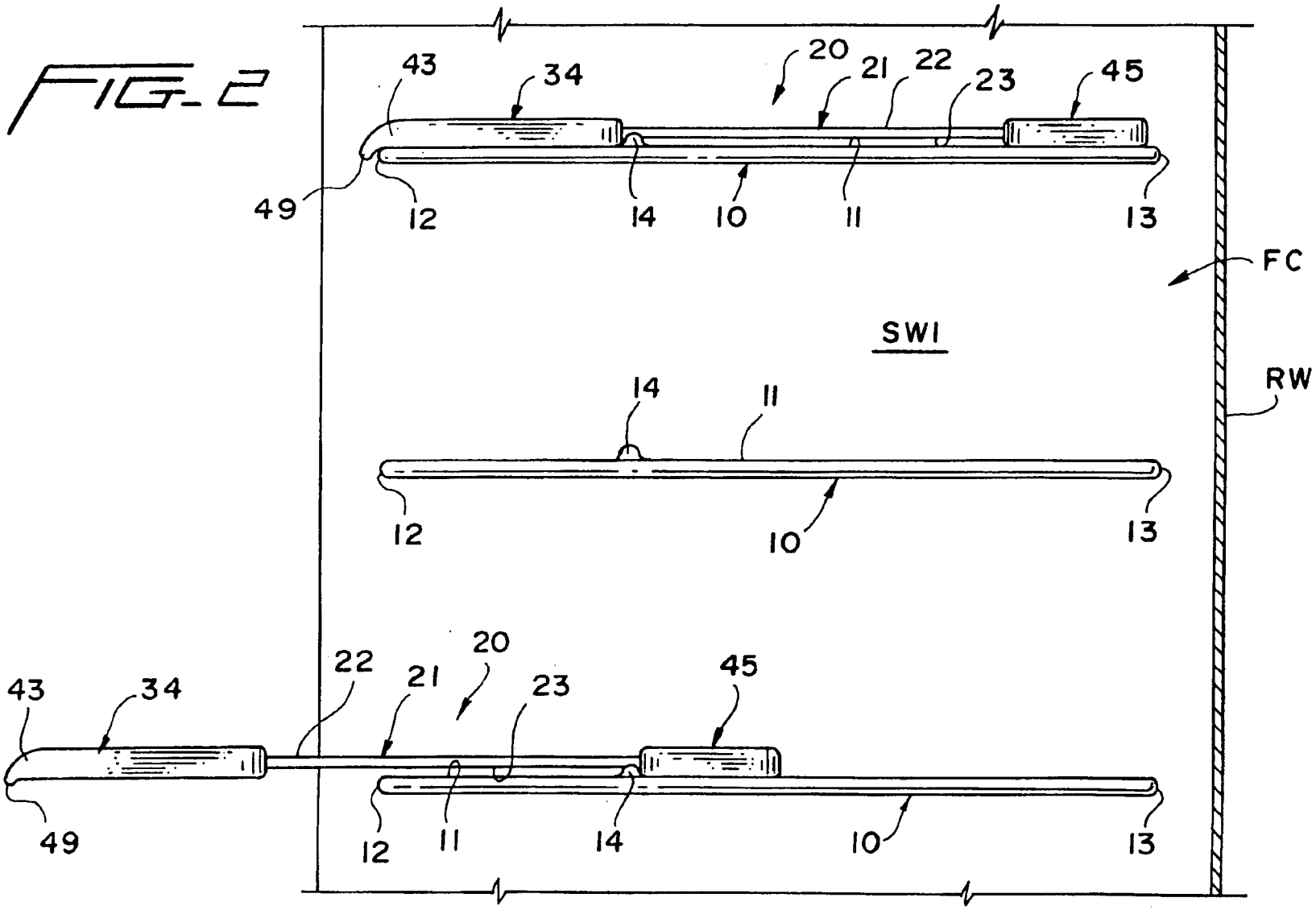
FIG. 2 is an enlarged fragmentary vertical cross-sectional view through the freezer compartment of FIG. 1, and more clearly illustrates the two shelves in their two positions and the manner in which a single abutment associated with each rib or ledge limits the rearward and forward movement of the shelf.

The shelf 20 is inserted within the fresh food compartment FFC or the frozen food FF compartment of the refrigerator R in the manner illustrated in FIGS. 1 and 2 of the drawings.

In each of FIGS. 1 and 2 of the drawings, the upper shelf 20 is illustrated in its innermost "home" position at which point the abutment means 14 of the ribs along the side walls SW1 and SW2 contact the respective noses 39, 38 of the front border member 34. The upper shelf 20 is supported by the side border portions 36, 37 and 47, 48 of the respective front and rear border members 34, 45 upon the upper surface 11 of the ribs 10. The latter support places the lower surface 23 (FIG. 2) of the glass panel 21 in spaced relationship to the upper surface 11 of each of the ribs 10 thereby affording the free flow of air therebetween and between the edge (unnumbered) of the exposed side edge portions 26, 27 of the upper shelf 20 and the respective side walls SW2 and SW1 of the freezer compartment FC. The latter construction provides excellent air flow through the spaces (unnumbered) provided between the side walls SW1, SW2, the ribs 10 and the edges 26, 27 of the shelves 20 and further exposes more of the glass of the glass panel 21 which collectively enhances the conductivity and thus the efficiency of the freezer compartment FC. The respective noses 38, 39 of the upper shelf 20 also contact the abutments 14 and preclude the upper shelf 20 from being slid further rearward than that illustrated in FIGS. 1 and 2 of the drawings thereby assuring a relatively large space (unnumbered) between the shelves, the products supported thereupon, and the rear wall RW of the freezer compartment FC which also enhances air flow and efficiency.

The front border wall portion 43 of the upper shelf 20 can, of course, be grasped and pulled forward which will allow this shelf to slide along the ribs 10 eventually reaching the position shown by the lowermost shelf 20 in FIGS. 1 and 2 at which point the respective noses 47, 48 of the rear border member 45 contact the abutments 14 of the ribs 10. The latter relationship prevents further outward movement of the lowermost shelf 20 of FIG. 1 than beyond the illustrated position thereof.

Reference is made to FIGS. 6 and 7 of the drawings in which another shelf constructed in accordance with this invention is illustrated and bears the reference character 20' with other primed reference numbers corresponding to identical structure as that heretofore described relative to the shelf 20. As compared to the shelf 20, the shelf 20' includes a tempered glass panel 21' and injection molded or post adhesively bonded to a front edge 24' and a rear edge 25' are respective front and rear border members 34' and 45'. However, the border members 34', 45' of the shelf 20' lack the side border portions 47, 48 and 36, 37 of the respective border members 45, 34 of the shelf 20. The structure of the shelf 20' absent the side border portions 36, 37 and 47, 48 of the border members 34, 35, respectively, of the shelf 20 expose the substantially entire side edges 26', 27' of the shelf 20' to the interior of a freezer compartment FC' (FIG. 7) of a refrigerator R' to thereby increase the conductivity, air flow and the efficiency of the latter. Moreover, due to the absence of the side border portions 36, 37, 47 and 48, the shelf 20' is thereby adapted to be essentially nonslidably fixed in any selected position of vertical adjustment because the distance between the front border member 34' and the rear border member 45' corresponds to the distance between the entrance ends 12' and the rear ends 13' of the ribs 10' in the manner illustrated in FIG. 7. Thus, the ends 12', 13' of the ribs 10' essentially abut the respective front border member 34' and the rear border member 45' to prevent the shelf 20' from moving relative to the rails 10', as is readily apparent from FIG. 7 of the drawings.

Reference is made to FIG. 8 of the drawings which illustrates an identical shelf 20" as that heretofore described relative to FIGS. 6 and 7, but in this case the shelf 20" is supported by seating upon projections 12", 13" projecting outwardly from a side wall (unnumbered) of an associated refrigerator R". The opposite unillustrated side wall has projections aligned with the projections 12", 13" in a conventional manner. Thus, the projections 12" and 13" contact respective front and rear border members 34", 45" of the shelf 20" to prevent movement of the latter.

Figure 9:
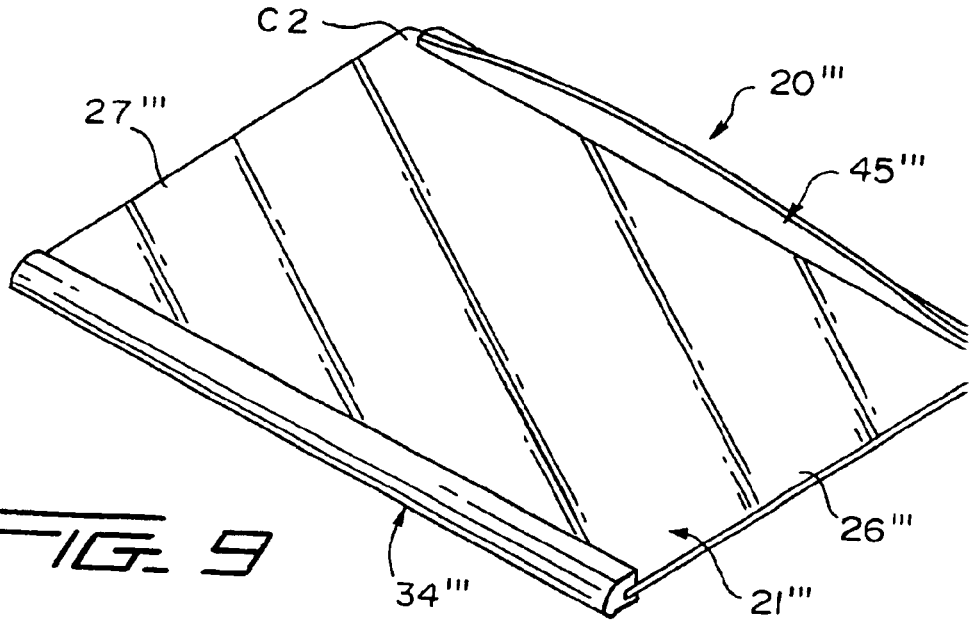
FIG. 9 is a top perspective view of another shelf constructed in accordance with this invention, and illustrates a tempered glass panel having front and rear border members injection molded to respective front and rear edges of the glass panel with rear corners of the glass panel being exposed to effect slidable movement of the shelf in association with ribs or ledges of an associated refrigerator compartment.
Figure 10:
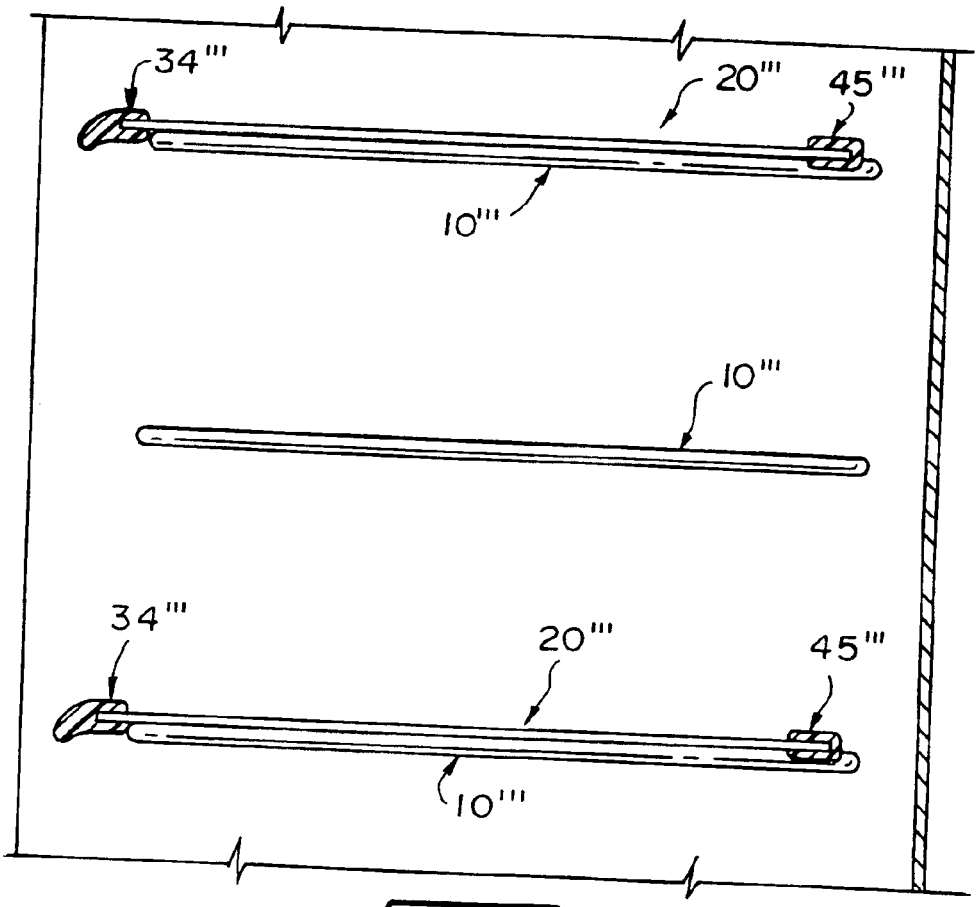
FIG. 10 is a vertical cross-sectional view through a refrigerator compartment, and illustrates the shelf of FIG. 9 supported by underlying ledges or ribs contacting only side edges of the glass panel.

A final shelf constructed in accordance with this invention is illustrated in FIGS. 9 and 10 of the drawings and is identified by the reference numeral 20'". The triple primed reference characters identify structure identical to the structure of the shelf 20". The shelves 20", 20'" are identical except a rear border member 45'" of the shelf 20'" is shorter than the distance between edges 26'", 27'" of a tempered glass panel 21'" thereby exposing rear corners C1, C2 of the respective side edges 26", 27'". Thus, the side edges 26'", 27'" are entirely exposed along the length thereof except for the minor portions thereof covered at the front corners (unnumbered) of the tempered glass panel 21'". By thereby exposing the corners C1, C2 of the tempered glass panel 21'", the edges 26'", 27'" can slide along opposing aligned ledges or ribs 10'" in the manner readily apparent therefrom. In this case, the ribs 10'" are not provided with abutments or stops, and thus care must be exercised when the shelf 21'", including contents thereupon (not shown), is slid to the left, as viewed in FIG. 10, to preclude accidental or inadvertent tilting or tipping.

Though the front and rear border members 34, 45, for example, are either injection molded to the respective front and rear edges of the glass panel 21, the front and rear border members 34, 45 can be individually injection molded, as described earlier herein with each including a respective channel 35, 52. The respective edges 24, 25 of the glass panel 21 can then be bonded in the channels 44, 52 of the respective border members 34, 45. Though the latter obviously requires additional material (adhesive) and an additional assembly step, as opposed to injection molding the borders 34, 45 directly to the glass panel 21, the advantage of adhesively bonding the border members 34, 45 is that they can be injection molded at one location, shipped to another location, and post attached at the latter location. The shipping of the lighter less fragile border members to the location of the glass panels 21 reduces transportation costs and, obviously, eliminates any issue concerning glass breakage (until after final assembly and shipment of the shelves 20).

Although a preferred embodiment of the invention has been specifically illustrated and described herein, it is to be understood that minor variations may be made in the apparatus without departing from the spirit and scope of the invention, as defined by the appended claims.

What is claimed is:

1. A refrigerator compartment comprising substantially parallel side walls and a rear wall therebetween, a plurality of substantially vertically spaced shelf-supporting ledges along each of said side walls, said shelf-supporting ledges being disposed in substantially horizontally aligned pairs, at least one slidable shelf defined by a piece of glass and front and rear border members each made of a single piece of substantially homogeneous polymeric/copolymeric molded synthetic material, said glass piece having opposite side edges and opposite front and rear edges, said front and rear border members each being of a substantially U-shaped configuration defined by a border bight portion and opposite substantially parallel side border portions having respectively a glass piece front edge-receiving channel and a glass piece rear edge-receiving channel, said opposite side border portions of said front and rear border members being in opposing relationship to each other, said front edge-receiving channel merging with side edge-receiving channels of said front border member side border portions, said rear edge-receiving channel merging with side edge-receiving channels of said rear border member side border portions, said channels front and rear edge-receiving channels and said side edge-receiving channels of said front border side border portions and said rear border side border portions open in opposing relationship to each other, said glass piece front, rear and side edges being received in the respective glass piece front edge-receiving, rear edge-receiving and side edge-receiving channels, said at least one slidable shelf being disposed with said front and rear border members in sliding relationship to one of said horizontally aligned pair of shelf-supporting ledges with said piece of glass being thereby spaced above said horizontally aligned pair of shelf-supporting ledges, and at least a portion of each glass piece side edge disposed between said front and rear border members side border portions being substantially completely exposed whereby air flow within the refrigerator compartment is enhanced.

2. The refrigerator compartment as defined in claim 1 including a space between each shelf-supporting ledge and an associated exposed glass piece side edge portion to effect air flow therebetween thus further enhancing conductivity within the refrigerator compartment.

3. The refrigerator compartment as defined in claim 2 wherein said opposite side border portions of said front and rear border members are supported by said ledges.

4. The refrigerator compartment as defined in claim 2 wherein said front and rear members are injection molded upon and are thereby bondingly secured to said respective glass piece front and rear edges.

5. The refrigerator compartment as defined in claim 2 wherein said front and rear members are injection molded, and adhesive means for bondingly securing said front and rear members to said respective glass piece front and rear edges.

6. The refrigerator compartment as defined in claim 2 wherein said front and rear border members are each in situ injection molded in bonded relationship to said piece of glass.

7. The refrigerator compartment as defined in claim 1 wherein said opposite side border portion of said front and rear border member are supported by said ledges.

8. The refrigerator compartment as defined in claim 7 wherein said front and rear border members are each in situ injection molded in bonded relation to said piece of glass.

9. The refrigerator compartment as defined in claim 1 wherein said front and rear members are injection molded upon and are thereby bondingly secured to said respective glass piece front and rear edges.

10. The refrigerator compartment as defined in claim 1 wherein said front and rear members are injection molded, and adhesive means for bondingly securing said front and rear members to said respective glass piece front and rear edges.

11. The refrigerator compartment as defined in claim 1 wherein said front and rear border member are each in situ injection molded in bonded relationship to said piece of glass.

12. A slidable shelf particularly adapted for use in a refrigerator compartment comprising a piece of glass and front and rear border members each made of a single piece of substantially homogeneous polymeric/copolymeric molded synthetic material, each front and rear border member having a lower support surface adapted for sliding support in an associated refrigerator compartment; said glass piece having upper and lower surfaces, opposite side edges and opposite front and rear edges; said front and rear border members each being of a substantially U-shaped configuration defined by a border bight portion and opposite substantially parallel side border portions having respectively a glass piece front edge-receiving channel and a glass piece rear edge-receiving channel, said opposite side border portions of said front and rear border members being in opposing relationship to each other, said front edge-receiving channels of said front border channel merging with side edge-receiving channels of said rear border member side border portion, said channels front and rear-receiving channels and said side edge-receiving channels of said front border side border portions and said rear border side border portions open in opposing relationship to each other, said glass piece front, rear and side edges being received in the respective glass piece front edge-receiving, rear edge-receiving and side edge-receiving channels, and at least a portion of each glass piece side edge disposed between said front and rear border members said border portions being substantially completely exposed with said glass piece lower surface being spaced above a plane through said front and rear border member lower surfaces whereby air flow within an associated refrigerator compartment is enhanced.

13. The shelf as defined in claim 12 wherein said glass piece front and rear edges define with said glass piece side edges corner portions of said glass piece, and said corner portions are substantially encapsulated by said front and rear border members.

* * * * *